United States Patent [19]

Bowerman

[11] 4,364,146

[45] Dec. 21, 1982

[54] QUICK CLEANOUT FOR UPRIGHT VACUUM CLEANER

[75] Inventor: Leonard E. Bowerman, Fairfield, Conn.

[73] Assignee: Electrolux Corporation, Greenwich, Conn.

[21] Appl. No.: 210,708

[22] Filed: Nov. 26, 1980

[51] Int. Cl.[3] ..... A47L 9/00

[52] U.S. Cl. ..... 15/323; 15/339; 15/351

[58] Field of Search ..... 15/350, 351, 352, 339, 15/323

[56] References Cited

U.S. PATENT DOCUMENTS

| | | | |
|---|---|---|---|
| 2,878,481 | 3/1959 | Gerber et al. | 15/351 X |
| 3,634,905 | 1/1972 | Boyd | 15/350 |
| 3,797,064 | 3/1974 | MacFarland | 15/351 |
| 4,023,234 | 5/1977 | Martinec et al. | 15/339 X |
| 4,219,900 | 9/1980 | Dyer | 15/339 |

*Primary Examiner*—Chris K. Moore

[57] ABSTRACT

An upright vacuum cleaner having a ductwork system for carrying dust-laden air comprised of a plurality of interconnected sections. Some of the sections are quickly removable for dislodging debris within the sections and coincidentally exposing the remaining ductwork for cleaning out debris. A cleanout rod is stored within the upper body of the cleaner and is quickly removed to be inserted into the ductwork for dislodging debris therein.

13 Claims, 9 Drawing Figures

QUICK CLEANOUT FOR UPRIGHT VACUUM CLEANER

BACKGROUND OF THE INVENTION

This invention relates to an improved upright vacuum cleaner, including means for quickly dislodging debris in a clogged air passageway.

Due to the inherent nature of the ducts and passageways in a vacuum cleaner and the material carried through the ducts by the movement of air, there is a propensity for this material to collect, forming a clogged condition. This condition restricts the passage of air, thereby reducing the efficiency of the machine and in some instances cutting off the flow of air completely.

Heretofore, any clogged condition in the ductwork was corrected or attempted to be corrected by the operator through various makeshift means available in a household, such as prodding the clog with a wire coat hanger which has been cut and straightened for insertion into the ductwork. Failing this, a serviceman was called in to correct the problem.

In some vacuum cleaners, an access is located adjacent the areas considered the most likely to become clogged, and when the condition occurs, the access is removed and a prod or other suitable device inserted through the opening to dislodge the restricting material. Obviously, only a limited area can be reached by this method.

Accordingly, it is an object of the present invention to provide an upright vacuum cleaner having a system of ductwork that is quickly and easily accessible for cleaning. It is further an object to provide the suitable cleaning instrument or prod with the upright vacuum cleaner conveniently stored as part of the cleaner.

SUMMARY OF THE INVENTION

In accordance with the present invention, there is provided an upright vacuum cleaner including a ductwork system having quickly removable sections for dislodging clogged material therein and to provide easy accessibility to that remaining ductwork, for cleaning, which is not removable.

There is further provided a cleanout rod having sufficient length and flexibility to permit prodding through the longest section of the ductwork in the vacuum cleaner.

There is also provided a storage space for the cleanout rod within the upper body of the vacuum cleaner designed so that the rod can be easily and quickly removed and replaced.

DETAILED DESCRIPTION OF THE INVENTION

Figure 1A:
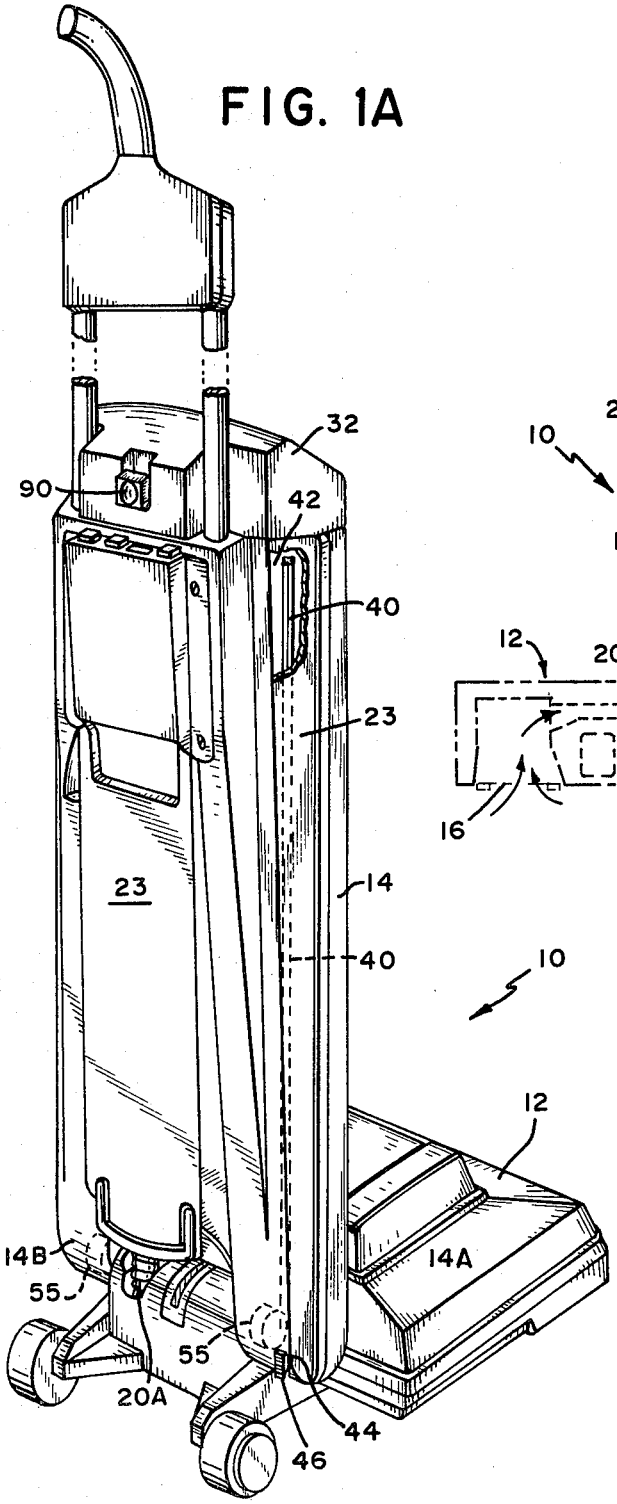
FIG. 1A is a perspective view of an upright vacuum cleaner of the present invention, showing the cleanout rod stored within the upper body of the cleaner.
Figure 1B:
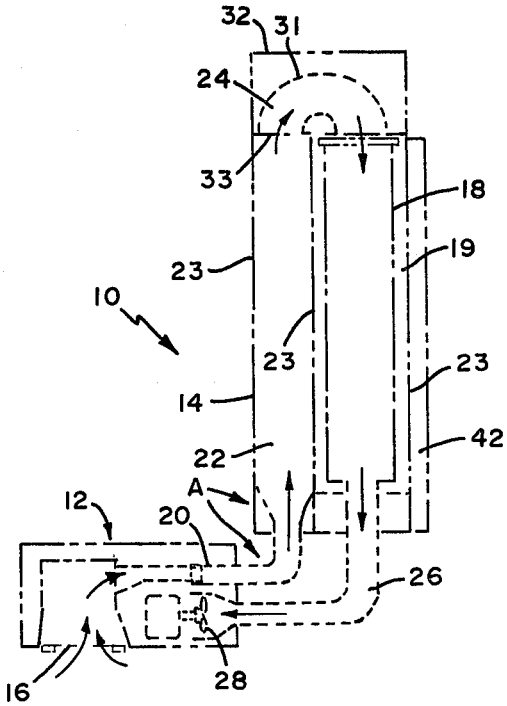
FIG. 1B is a schematic showing the basic arrangement of components of the upright vacuum cleaner shown in FIG. 1A.

Referring particularly to FIGS. 1A and 1B, an upright vacuum cleaner generally designated numeral 10 includes a base 12 and an upper body 14 mounted on the base 12. As schematically shown in FIG. 1B, dust-laden air is drawn through a nozzle in the base 12 and is carried into a filter bag 18, in a filter compartment 19 in the upper body 14, throug ductwork comprising a lower duct assembly 20 in the base 12, a main duct 22 in the upper body and an arcuate-shaped duct 24 in a cover 32. Filtered air is exhausted from the filter compartment 19 through an exhaust duct assembly 26 by virtue of its being connected to a motor-fan unit 28 supported in the base 12. The upper body 14 has an elongated shape and extends substantially upwardly relative to the base 12. Outer and inner wall means 23 serve to form the filter compartment 19 which extends longitudinally in the upper body and has an open top end to receive the filter bag 18, and an opening at the lower end for communicating with the exhaust duct assembly 26. The wall means 23 also form the main duct 22 which extends substantially parallel to the filter compartment 19 and adjacent thereto and having open top and bottom ends. The cover 32 is removably attached to the upper end of the upper body 14. Wall means 31 within the cover 32 form the arcuate duct 24 which interconnects the top end of the main duct 22 with the top end of the filter compartment 19.

Due to the nature of the debris being vacuumed, there is a tendency for one or more of the particles to become lodged in the ductwork, especially in areas indicated A (FIG. 1B) adjacent the curved portions which would obviously be the most inaccessible sections of the system. It is apparent that the clinging tendency can lead to a clogged situation within the ductwork. In order to assist dislodging the clogged debris, a cleanout rod 40 (FIGS. 1-4) is provided, preferably having a length longer than the length of the main duct 22. As shown in FIG. 1, the cleanout rod is conveniently stored in a compartment 42, formed by wall means 23 and 25, which extends substantially the full length of the upper body 14 and has an opening 44 at the lower end thereof to receive the cleanout rod 40. The cleanout rod can be made of any suitable material such as plastic and has longitudinally extending ribs 41 to provide sufficient rigidity while yet maintaining some flexibility, nevertheless, which is inherent in the material and is desirable to permit the rod to negotiate a shallow bend or offset in the ductwork wherever necessary. A handle 46, also of plastic material and suitably attached in this embodiment to one end of the cleanout rod 40, is contoured as at 47 to conform to the shape of the lower portion of the upper body 14 to close the opening 44 when the rod 40 is stored within the compartment 42. A projecting tab 48 having a serrated surface 49 is formed as an integral part of the handle 46 for manually grasping the handle to withdraw the rod 40 from the compartment 42.

Detent means 50, comprising a projection 51 on the handle 46 which cooperates in a detent groove 52 in the wall of the upper body 14 adjacent the opening 44, serves to retain the cleanout rod 40 within the storage compartment 42.

Figure 6:
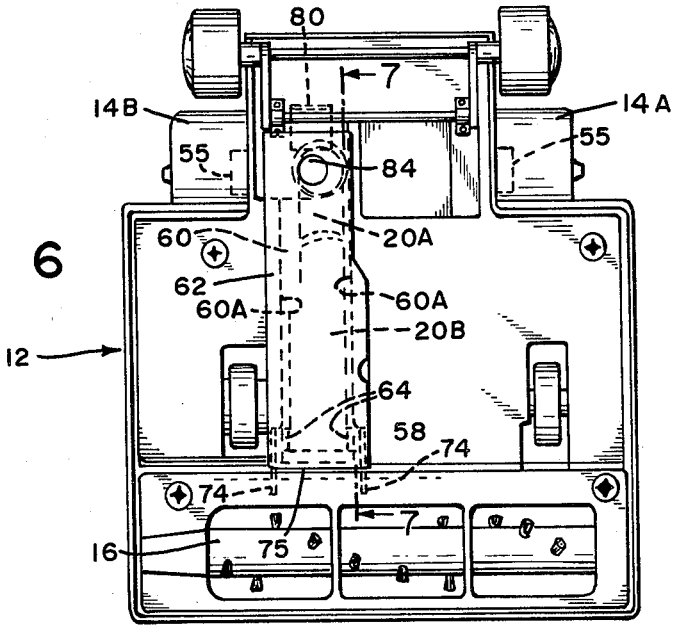
FIG. 6 is a bottom view of the base assembly showing the relationship of the ductwork to the nozzle and a manually removable cover.
Figure 7:
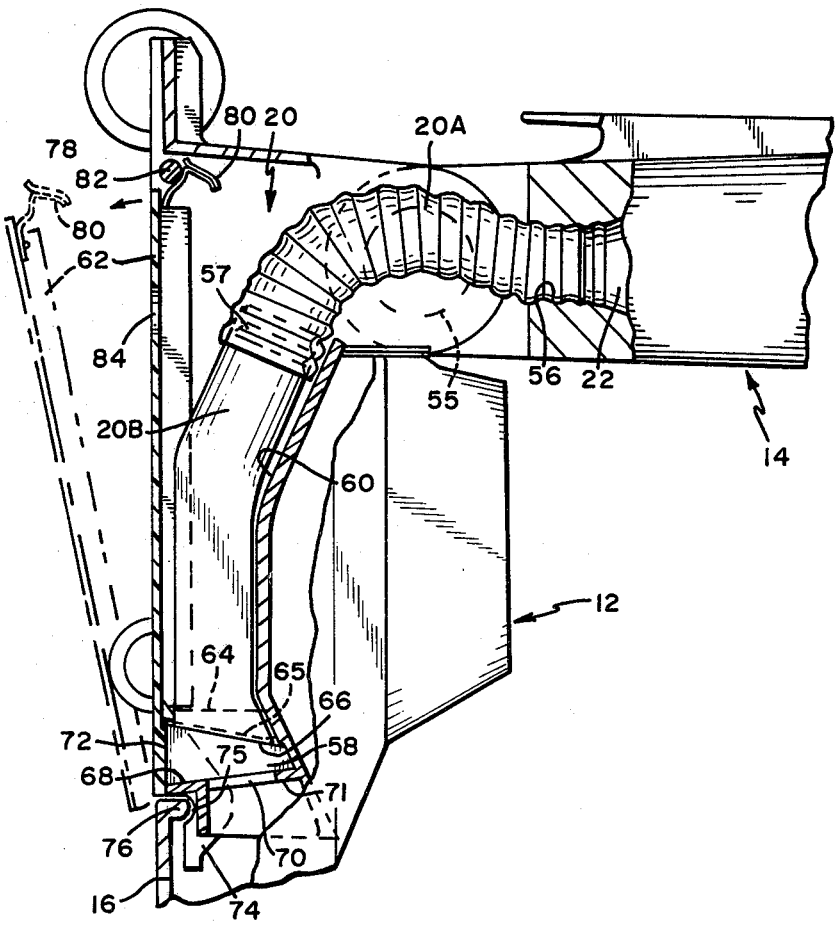
FIG. 7 is a sectional view taken along line 7—7 of FIG. 6.
Figure 8:
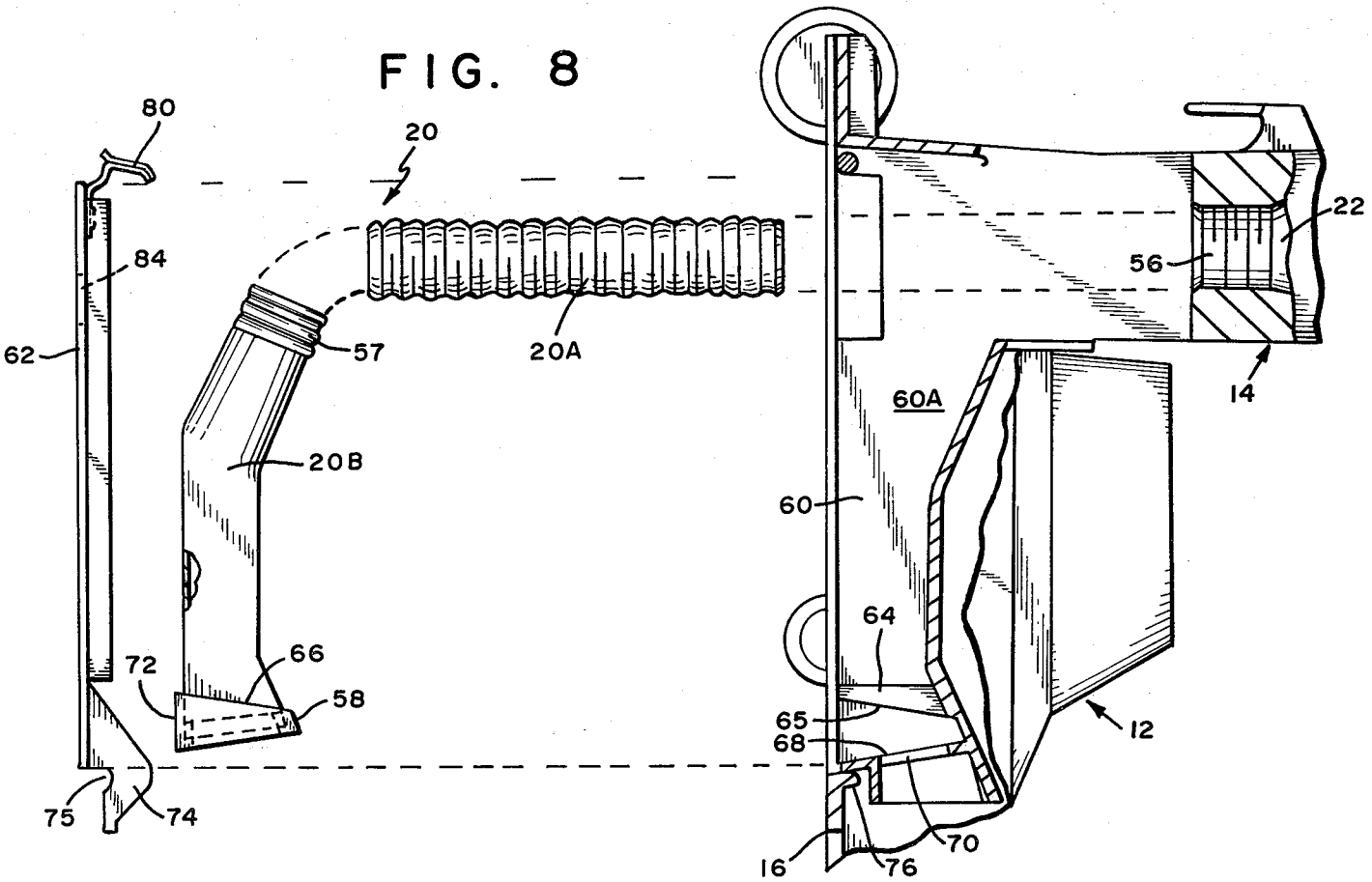
FIG. 8 is an exploded view similar to FIG. 7 showing the cover and lower ductwork removed to expose the passageway into the upper body ductwork.

As is best illustrated in FIGS. 1B and 6, the upper body 14 has bifurcated ends 14A and 14B which are attached to the base assembly 12 on spaced pivots 55 to permit movement of the upper body relative to the base assembly during operation of the vacuum cleaner 10. In order to accommodate this pivotal movement, the lower ductwork assembly 20 includes a flexible hose 20A and a rigid duct 20B. The flexible hose 20A is connected to the lower end of the main duct 22 by a threaded connection 56. The other end of the flexible hose is attached by a threaded connection 57 to one end of the rigid duct 20B, as shown in FIGS. 6, 7 and 8. The other end of the duct 20B carries a seal 58 surrounding the open end thereof for preventing leakage of air, as will be described below. An inverted channel 60 is formed in the base 12 and is contoured to receive the rigid duct 20B which is retained within the channel by a cover 62. The opposed sidewalls 60A are provided with a boss 64 having an inclined edge 65 which cooperates with a mating edge 66 on the seal 58 in a wedging manner to force the seal against a surface 68 surrounding an opening 70 in the nozzle wall 71. This is accomplished when the cover 62 is closed, pressing against a surface 72 on the seal 58, thus providing a leakproof communication between the interior of the nozzle and the interior of the rigid duct 20B.

The cover 62 is formed with two spaced ears 74 projecting from either side of its lower end, which are provided with an in-line notch 75 to receive an edge 76 of the nozzle frame to function in the manner of a fulcrum for the cover. The cover is held in position by a spring latch 78 comprising a leak spring 80 attached to the upper end of the cover 62 which cooperates with a rod 82 in the base 12. A hole 84 near the upper end of the cover is provided for inserting a finger to manually remove the cover.

Figure 2:
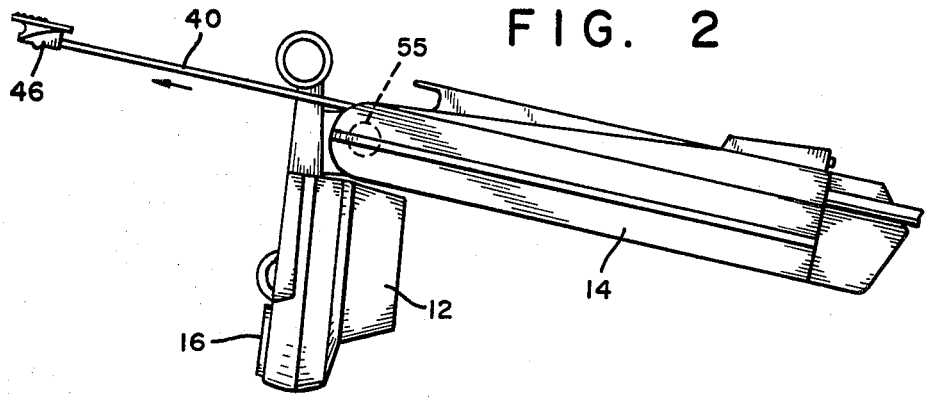
FIG. 2 is a side view of the cleaner positioned so as to remove the cleanout rod and showing the rod partially removed.
Figure 3:
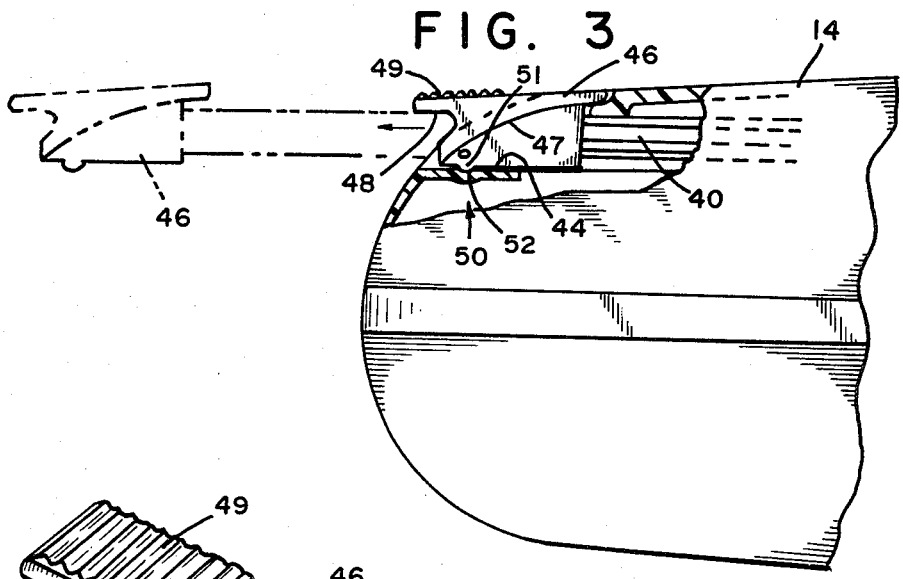
FIG. 3 is an enlarged view, partly in section, of the lower end of the upper body and showing the end of the cleanout rod including the handle incorporating means for securing the rod within the upper body.
Figure 4:
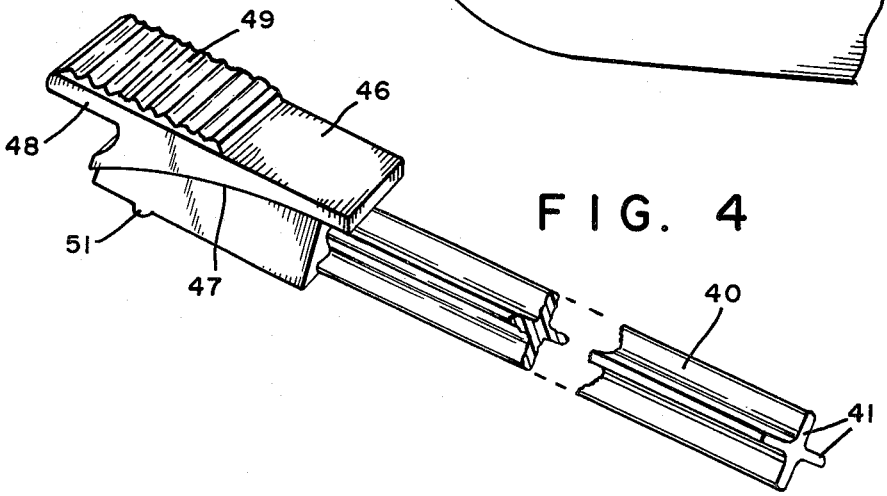
FIG. 4 is a perspective view of the preferred embodiment of the cleanout rod.
Figure 5:
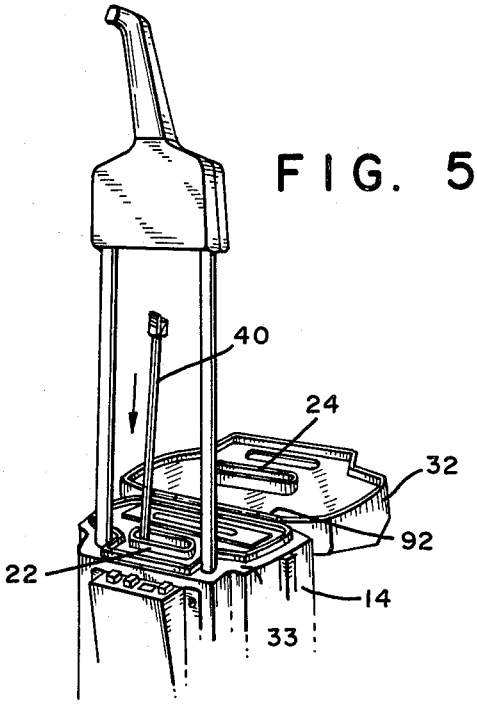
FIG. 5 is a perspective view of the top portion of the upper body showing the bag access cover in open position to expose the ductwork.

In operation, when a clogged condition develops, the cover 32 which is attached to the upper body 14 by a hinge 92 is opened by pressing a button 90 to release a latch as seen in FIGS. 1B and 5. The cleanout rod 40 is withdrawn from its compartment 42 by grasping the handle 46. This is best accomplished by tipping the vacuum cleaner forward into a position as shown in FIG. 2. The cleanout rod 40 is then inserted into the main duct 22 as seen in FIG. 5 to prod the clog loose. In the event the clog is in the lower portion of the main duct 22 or in the lower ductwork 20, the vacuum cleaner is tipped into the position of FIG. 2, the lower ductwork is quickly removed by first manually opening the cover 62, second, lifting out the duct assembly 20 and unscrewing it from the duct 20C providing access to the lower end of the main duct 22, as shown in FIG. 8. It will now become apparent that the cleanout rod 40 can easily be inserted into the lower end of the main duct 22 in the upper body 12 as well as the upper end as shown in FIG. 5, thereby quickly disloding the clog inside this duct system. Obviously, the flexible hose 20A and the rigid duct 20B can be quickly unclogged by use of the cleanout rod. The components are then reassembled by manually screwing the flexible hose into the end of duct 20C and similarly attaching the rigid duct 20B to the hose 20A and inserting it into the channel 60 after which the notched ears 74 are placed upon the edge 76 and the cover 62 pivotally moved into closed position. The cleanout rod 40 is then returned to its compartment and the vacuum cleaner turned upright and after closing the cover 32, is ready for operation.

The specific embodiment shown and described above is merely for the purpose of illustrating the essence of the present invention and should not be construed as limiting its scope, which is determined by the appended claims.

What is claimed is:

1. In an upright vacuum cleaner of the type having a base, suction means mounted in said base, nozzle means formed in said base, an elongated upper body supported on said base for pivotal movement and extending upwardly therefrom, wall means forming a main air duct havng open top and bottom ends and extending longitudinally within said upper body, wall means forming a filter compartment adjacent said main air duct open at the top and extending parallel to said main duct, said filter compartment havig a reduced opening at its lower end, a dust bag removably received in said filter compartment, a removable cover for closing the top end of said main air duct and said filter compartment, means forming an arcuate-shaped air duct within said cover for interconnecting said main air duct with said filter compartment when said cover is in closed position, a lower air duct means supported in said base and connecting said nozzle means with the bottom end of said main air duct, an exhaust air duct connecting the lower end opening in said filter compartment with said suction means, the improvement comprising quick coupling means incorporated in said lower air duct means to remove said lower air duct means for cleaning, a cleanout rod for inserting into said lower air duct means, when dismantled, and said main duct to dislodge clogged debris therein, and wall means forming an open-ended compartment in said upper body for removably receiving said cleanout rod for storage.

2. The improvement of claim 1, wherein the base is formed having portions defining an inverted channel having an open lower side and extending from said nozzle means to adjacent said main air duct to removably receive said lower air duct means in a manner interconnecting said nozzle means with said main air duct, and a removable cover for closing the open lower side or said channel to retain said lower air duct means therein.

3. The improvement of claim 1, characterized in that said storage compartment is formed having detent means adjacent the open end thereof and said cleanout rod is formed having a longitudinal body portion and a handle portion and detent means formed in the handle portion for cooperating with the detent means in said storage compartment for removably retaining said cleanout rod in said storage compartment.

4. The improvement of claim 3, characterized in that said lower air duct means is composed of a flexible section removably connected at one end to said main air duct, and a rigid section removably connected at one end to the free end of said flexible section and the other end of said rigid section being held in communicating relation with said nozzle means by the force of said cover against said rigid section.

5. The improvement of claim 4, characterized in that said nozzle is formed with a wall having an exhaust opening communicating with said inverted channel and bosses formed in opposed walls of said channel, said bosses having an inclined edge adjacent the exhaust opening, and a seal surrounding the end of said rigid section and having opposed inclined trailing edges for cooperating with the inclined edges of said bosses in a wedging manner to fit the seal against the nozzle wall by virtue of the force of said cover upon said rigid duct to form an effective sealing connection.

6. The improvement of claim 5, characterized in that said main air duct has screw threads formed in its lower end and said flexible section of said lower air duct has screw threads formed in either end, one end for mating in the threaded lower end of said main air duct and the other end mating with the threaded end of said rigid section.

7. A vacuum cleaner comprising housing means, nozzle means for picking up debris, debris-handling duct means having one end connected to said nozzle means, air-moving means for applying suction via said duct means to said nozzle means to pick up debris, and filter means so positioned relative to said air-moving means and said duct means as to be operative to filter debris, a cleanout rod for insertion into said duct means to dislodge clogged debris therefrom, and said housing means having storage means for removably receiving said cleanout rod for storage.

8. The vacuum cleaner of claim 7, wherein said storage means comprises wall means constituting a portion of said housing means and defining a compartment in said housing for removably receiving said cleanout rod.

9. The vacuum cleaner of claim 8, wherein said storage compartment is formed having detent means adjacent the open end thereof and said cleanout rod is formed having a longitudinal body portion and a handle portion and detent means formed in said handle portion for cooperating with said detent means of said storage compartment for removably retaining said cleanout rod in said storage compartment.

10. The vacuum cleaner of claim 7, wherein said duct means consists of a plurality of sections, each said section being disconnectable from at least one of the adjacent said sections to enable cleaning of the disconnected section by means of said cleanout rod, whereby the entire length of said duct means can be cleaned by means of said cleanout rod.

11. The vacuum cleaner of claim 10, wherein one said section comprises lower air duct means having one end detachably attached to said nozzle means.

12. The vacuum cleaner of claim 11, wherein a second said section comprises main air duct means having one end detachably attached to the second end of said lower air duct means.

13. The vacuum cleaner of claim 12, wherein said second section is oriented parallel to said filter means, and wherein a third said section comprises an arcuate air duct having one end detachably attached to said filter means and having a second end detachably attached to the second end of said second section.

* * * * *